United States Patent [19]

Dor-el et al.

[11] Patent Number: 4,736,953

[45] Date of Patent: Apr. 12, 1988

[54] BOARD GAME

[76] Inventors: David Dor-el, 361 S. Elm Dr. #3, Beverly Hills, Calif. 90212; Margalit Lipkin, 22, Burla St. #20, Tel-Aviv, Israel, 69364

[21] Appl. No.: 739,893

[22] Filed: May 31, 1985

[51] Int. Cl.[4] ..... A63F 3/00

[52] U.S. Cl. ..... 273/236

[58] Field of Search ..... 273/267, 276, 236, 309, 273/148 A, 272

[56] References Cited

U.S. PATENT DOCUMENTS

| | | | |
|---|---|---|---|
| 3,850,434 | 11/1974 | Ockenfels | 273/236 X |
| 4,227,698 | 10/1980 | Ishizuki | 273/303 X |
| 4,390,183 | 6/1983 | Gedon | 273/148 A |

OTHER PUBLICATIONS

Gibson, *Hoyle's Modern Encyclopedia of Card Games*, 11/80, pp. 291–295.

*Primary Examiner*—Matthew L. Schneider

*Attorney, Agent, or Firm*—W. Edward Johansen

[57] ABSTRACT

A new board game of logical, educational and entertainment values, for two or more players, which comprises: A playing board marked with a plurality of locations, divided into spaces, identical in shape and size. Playing pieces, blank on one side, and colored with numbers thereon on the other side. The playing pieces are identical in shape and equal in size to the spaces of the playing board. A container is provided for storing the playing pieces. A blinder is provided for each player to hide his/her playing pieces.

1 Claim, 2 Drawing Sheets

BOARD GAME

BACKGROUND OF THE INVENTION

Field of the Invention and Description of the Prior Art

The present invention relates to games involving logical, educational and entertainment values. Despite a large number of games using a board with a plurality of placement locations, or games where playing pieces already in the game can be played again (e.g., U.S. Pat. No. 4,413,828 [Gardner, Nov. 8, 1983]; U.S. Pat. No. 4,258,922 [Landry, Mar. 31, 1981]; U.S. Pat. No. 4,005,867 [Yaeger, Feb. 1, 1977]; U.S. Pat. No. 3,977,681 [Deitrich, Aug. 31, 1976]; U.S. Pat. No. 3,677,549 [Moscovitch, July 18, 1972]; all from U.S. C.L. and Field of Search: 273/236; 273/283; 273/284; and in other publications, such as "500 Rum," pp. 109–110, and "Bezique," pp. 147–149, both from "Playing According to Hoyle," Signet, 1965, and "Oklahoma Rummy," pp. 76–77, and "Two-Handed Pinochle," pp. 171–173, both from: "Scarne's Encyclopedia of Games," Harper & Row, 1973). None of the prior art known to the applicants is similar, nor closely resemble the present invention, *where decision-making by the players must be announced before each move.*

It is, therefore, a primary object of the present invention to provide a board game where a decision made by a player, i.e., the next move, must be announced before each move.

SUMMARY OF THE INVENTION

The present invention provides:

A playing board divided into two parts, i.e., the main board in use when two players are playing, and an extra board, to be used, together with the main board, when more than two players are playing.

The playing board is marked with a plurality of placement locations (fields). These fields are divided into identical spaces, where playing pieces (bars) can be placed. the bars and the spaces are identical in shape and equal in size.

The bars are blank on one side and colored with a numeral thereon on the other side. These bars are stored in a container.

Each player is supplied with a blinder to hide his/her bars.

Players must place all the bars in their possession on the fields according to the rules. When one of the players manages to do so, the game is over.

A collection of three or four bars of different colors and the same matching numbers is called a simple-set. A collection of three or more bars of the same color in consecutive numerical order is called a straight-set. The number of bars that can be placed on any field must be equal to the number of spaces on this field.

The present invention is a method of playing a board game, comprising the following steps (rules) of:

Players decide who plays first. Each player, in turn, draws six bars by a random means, placing these bars under his/her blinder, and play always continues to the left. During their turn, players must place one of their sets on a proper vacant field to get in the game, and the player must say: "I am placing a set to get in the game". If a player does not have such a set, he/she draws an extra bar from the container, trying again the next round, and play proceeds. Once in the game, the player must announce before his/her turn the number of extra bars he/she intends to place on the fields. Prior to placing them on the board, these bars must be disclosed face-up. These bars can be added to existing sets on the fields, creating new sets, which have to be replaced on new proper vacant fields, a player can rearrange the existing sets, in whole or part, together with the bars he/she intends to get rid of into new sets and place these new sets on proper vacant fields. Any extra bar which cannot be placed properly on any of the fields must be placed on field-X, which can accommodate any number of bars, and play proceeds. A player must announce before his/her turn, if he/she intends to end the game. This announcement cannot be made in the first two rounds. If a player fails to end the game, he/she is out of this game, the bars which he/she announced to place on the fields remain on the fields and/or field-X, and play proceeds.

Other ways for making a play are: A player may use bars that he/she intends to get rid of, together with bars from field-x; a player may use bars only from field-x; a player may decide not to make a play, instead taking an extra bar from the container, and play proceeds.

Bars from field-X cannot be used to form a set to get in the game. If no extra bar is left in the container, the game continues (including players who are not in the game yet, as they may later have an opportunity to get in the game when a proper field becomes vacant), until one of the players ends the game.

Only simple-sets and straight-sets can be used to place on the fields.

Although such novel feature or features, believed to be characteristic of the invention, are pointed out in the Claims, the invention, and the manner in which it may be carried out, may be further understood by reference to the following description and drawings, which are attached hereto, marked FIGS. 1 and 2, and incorporated by this reference.

DESCRIPTION OF THE PREFERRED EMBODIMENT

Figure 1:
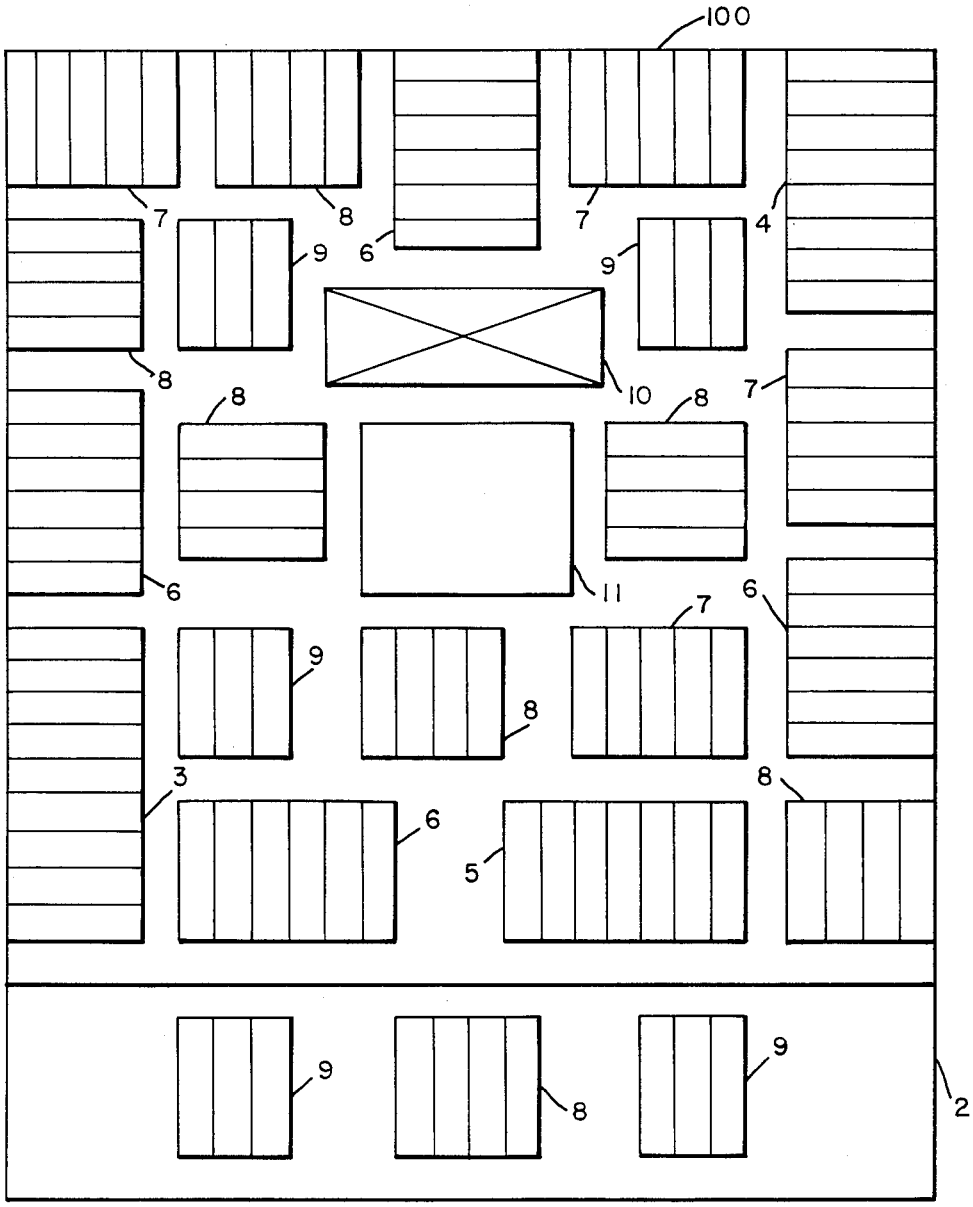
FIG. 1 is a plan view of the playing board.

Referring to FIG. 1, there is shown the playing board 100 divided into two parts: the main board 1, and the extra board 2. On the playing board, there are a plurality of fields. The fields are divided into identical and equal spaces, where bars can be placed. On the main board there are: three fields 9 with three spaces on each field; six fields 8 with four spaces on each field; four fields 7 with five spaces on each field; four fields 6 with six spaces on each field; one field 5 with seven spaces; one field 4 with eight spaces; one field 3 with nine spaces; one field 10 marked with "X" called field-x, where any number of bars can be placed. There is a container 11, where bars are stored. A hole (not seen) is cut in the middle of the board in which to place the container. The top of the container and the playing board are on the same level. On the extra board 2, there are: two fields 9 with three spaces on each field, and one field 8 with four spaces.

Figure 2:
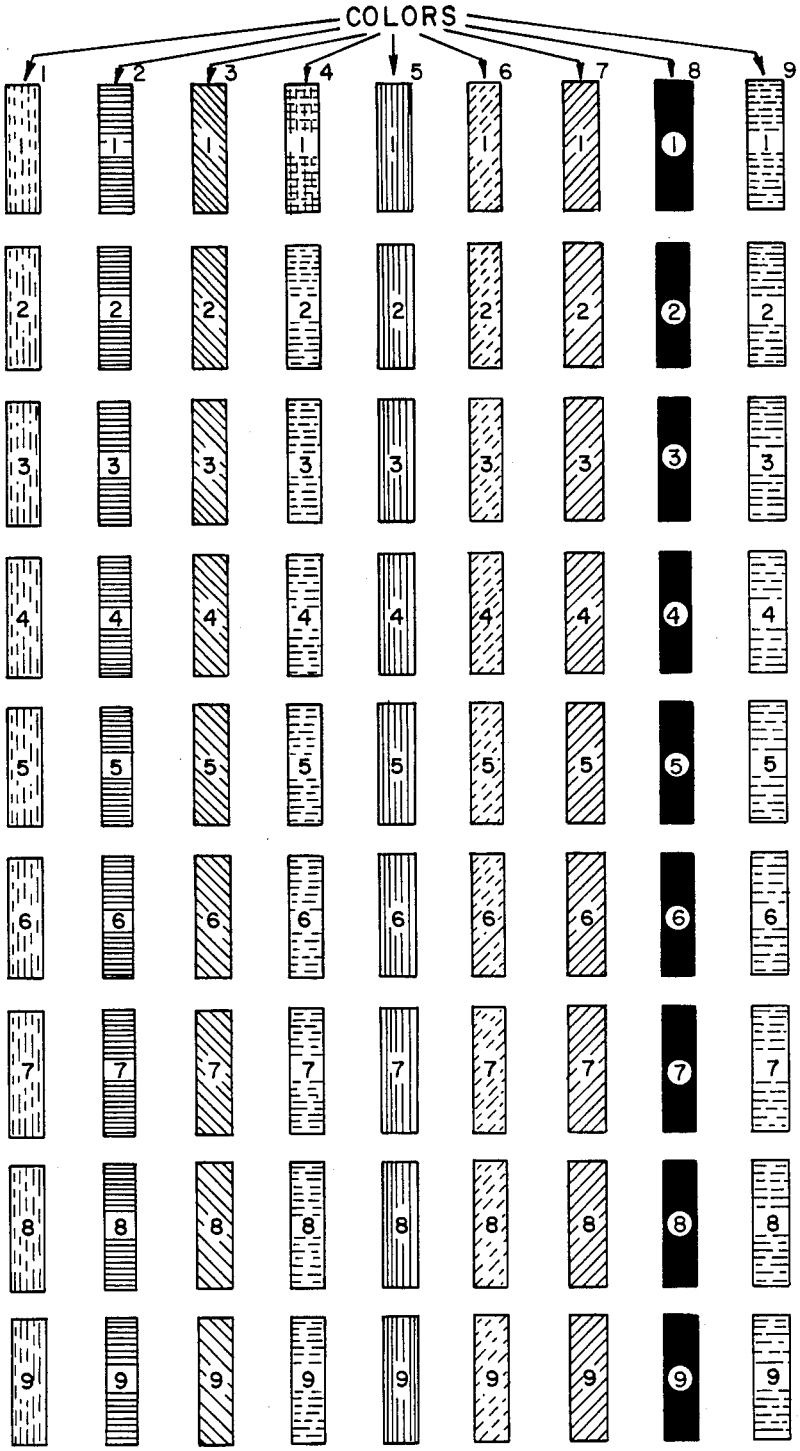
FIG. 2 shows the playing pieces (bars) that are used to play the present game.

Referring to FIG. 2, there is shown the bars used for playing the game. The bars are made of solid material, identical in shape and equal in size. They are blank on one side, and the other side (the face) is painted with one color out of nine different colors, respectively, and they carry one number thereon, out of the nine digits: 1 to 9, respectively. The bars and spaces on the fields illustrated in FIG. 1 are identical in shape and equal in size.

While the present invention has been shown and described in what is presently conceived to be the most practical and preferred embodiment, it will be apparent of ordinary skill in the art that many modifications can be made within the scope of the present invention, which scope is to be accorded the broadest interpretation of the appended claims so as to encompass all equivalent formats and rules of the present game only few to mention, giving special values to the fields, the colors, the digits, adding or reducing the number of fields, colors, and digits, all of which, without departing from the spirit of the present invention.

We claim:

1. A board game comprising a main game board, an extra board for use when more than two players are playing, playing pieces and view blocking means for blocking each player's view of the other players' collection of playing pieces; said playing pieces comprising a group of eighty-one playing pieces each having numerical indicia and color indicia thereon, each playing piece having a different combination of numerical indicia and color indicia; said main game board comprising a plurality of first fields, most of said first fields being divided into a plurality of spaces that are sized and shaped similar to the playing pieces so as to receive the playing pieces thereon during play of the game, said first fields being separate from one another and comprising three first fields each having three spaces, six first fields each having four spaces, four first fields each having five spaces, four first fields each having six spaces, one first field having seven spaces, one first field having eight spaces, one first field having nine spaces and one first field being a specially designated field, said board also having a centrally located recess for storing said playing pieces; said extra board comprising a plurality of second fields, most of said second fields being divided into a plurality of spaces that are sized and shaped similar to the playing pieces so as to receive the playing pieces thereon during play of the game, said second fields being separate from one another and comprising two second fields each having three spaces and one second field having four spaces.

* * * * *